US007654804B2

(12) United States Patent
Chu

(10) Patent No.: US 7,654,804 B2
(45) Date of Patent: Feb. 2, 2010

(54) FLUID DISPLACEMENT APPARATUS HAVING PRESSURE SENSING DEVICE

(76) Inventor: Henry C. Chu, 133 N. Lemon St., Orange, CA (US) 92866

( * ) Notice: Subject to any disclaimer, the term of this patent is extended or adjusted under 35 U.S.C. 154(b) by 1 day.

(21) Appl. No.: 12/008,020

(22) Filed: Jan. 8, 2008

(65) Prior Publication Data

US 2009/0175749 A1 Jul. 9, 2009

(51) Int. Cl.
*F01C 21/00* (2006.01)
*F03C 2/00* (2006.01)
*F04C 2/00* (2006.01)

(52) U.S. Cl. ..... 418/2; 418/55.1; 417/44.2; 417/902

(58) Field of Classification Search ..... 418/2, 418/55.1; 417/19, 32, 44.1, 44.2, 544.3, 417/2, 902
See application file for complete search history.

(56) References Cited

U.S. PATENT DOCUMENTS 4,955,795 A * 9/1990 Griffith ..... 417/44.3
5,200,872 A * 4/1993 D'Entremont et al. ..... 361/25
5,511,952 A 4/1996 Sato
6,497,554 B2 * 12/2002 Yang et al. ..... 417/44.2
7,290,989 B2 * 11/2007 Jayanth ..... 417/44.1
2006/0275143 A1 * 12/2006 Jayanth ..... 417/63

FOREIGN PATENT DOCUMENTS

JP 02104995 A * 4/1990 ..... 417/13

* cited by examiner

*Primary Examiner*—Theresa Trieu
(74) *Attorney, Agent, or Firm*—Charles E. Baxley

(57) ABSTRACT

A fluid displacement apparatus includes a housing for receiving a refrigerant, a driving shaft rotatably received in the housing, a magnetic clutch attached to the driving shaft for rotation transmitting purposes, a fixed scroll disposed in the housing, an orbiting scroll rotatably received and engaged in the housing and interfitting with the fixed scroll for compressing the refrigerant and for generating a pressurized refrigerant, the housing includes a compartment communicating with the inner chamber of the housing with a passage for receiving a pressure sensing device which may sense the pressure of the pressurized refrigerant for detecting whether the refrigerant in the housing is over pressure or not.

1 Claim, 4 Drawing Sheets

FLUID DISPLACEMENT APPARATUS HAVING PRESSURE SENSING DEVICE

BACKGROUND OF THE INVENTION

1. Field of the Invention

The present invention relates to a compressor or fluid displacement apparatus, and more particularly to a fluid displacement apparatus including a pressure sensing device for effectively detecting or sensing the inner pressure in a compressor housing and for detecting whether the fluid or refrigerant in the compressor housing is over pressure or not.

2. Description of the Prior Art

Typical compressors or fluid displacement apparatuses comprise interfitting fixed and orbiting scrolls disposed in an outer compressor housing for compressing the fluid or refrigerant received in the compressor housing.

Generally, in the conventional refrigerant compressor, when the temperature of the fluid or refrigerant excessively rises, the compressor is not operating normally and increased frictional resistance between the moving parts of the compressor will be occurred.

For preventing the temperature of the fluid or refrigerant excessively rises above the predetermined temperature, a thermal sensor is provided and disposed in a sensor pocket that is provided on the outer peripheral portion of the compressor housing for detecting or sensing the inner temperature of the compressor housing.

For example, U.S. Pat. No. 5,511,952 to Sato discloses one of the typical refrigerant displacement apparatuses with an improved thermal sensing device for detecting or sensing the temperature of the fluid or refrigerant received in the compressor housing, the compressor housing should be made of metal materials which are heat conductive for allowing the metal compressor housing to be heated by the fluid or refrigerant and then for allowing the temperature at the compressor housing to be detected or sensed by the thermal sensing device.

However, the flowing of the fluid or refrigerant should be precisely directed toward the thermal sensing device for allowing the temperature of the fluid or refrigerant to be effectively detected or sensed, and the temperature of the fluid or refrigerant may not be effectively detected or sensed if the flowing of the fluid or refrigerant is not precisely directed toward the thermal sensing device.

In addition, the temperature of the metal compressor housing may be increased or decreased or changed by the temperature at the outer environment of the compressor housing such that the temperature of the fluid or refrigerant to be precisely detected or sensed.

The present invention has arisen to mitigate and/or obviate the afore-described disadvantages of the conventional fluid displacement apparatuses.

SUMMARY OF THE INVENTION

The primary objective of the present invention is to provide a fluid displacement apparatus including a pressure sensing device for effectively detecting or sensing the inner pressure in a compressor housing and for detecting whether the fluid or refrigerant in the compressor housing is over pressure or not.

In accordance with one aspect of the invention, there is provided a fluid displacement apparatus comprising a housing including a chamber formed therein for receiving a refrigerant, and including an opening formed therein and communicating with the chamber of the housing, and including a compartment formed therein, and including a passage formed therein and communicating with the compartment and the chamber of the housing, a driving shaft rotatably received in the opening of the housing, a magnetic clutch attached to the driving shaft for rotation transmitting purposes, a fixed scroll disposed in the chamber of the housing, an orbiting scroll rotatably received and engaged in the chamber of the housing and interfitting with the fixed scroll for compressing the refrigerant and for generating a pressurized refrigerant, and a pressure sensing device disposed in the compartment of the housing for sensing a pressure of the pressurized refrigerant.

The housing includes a casing having the compartment formed in the casing, and the casing includes an opening for engaging the pressure sensing device into the compartment of the casing.

The housing may further include a sealing ring engaged between the pressure sensing device and the casing for making an air or water tight seal between the pressure sensing device and the casing or the housing and for preventing the refrigerant from leaking.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
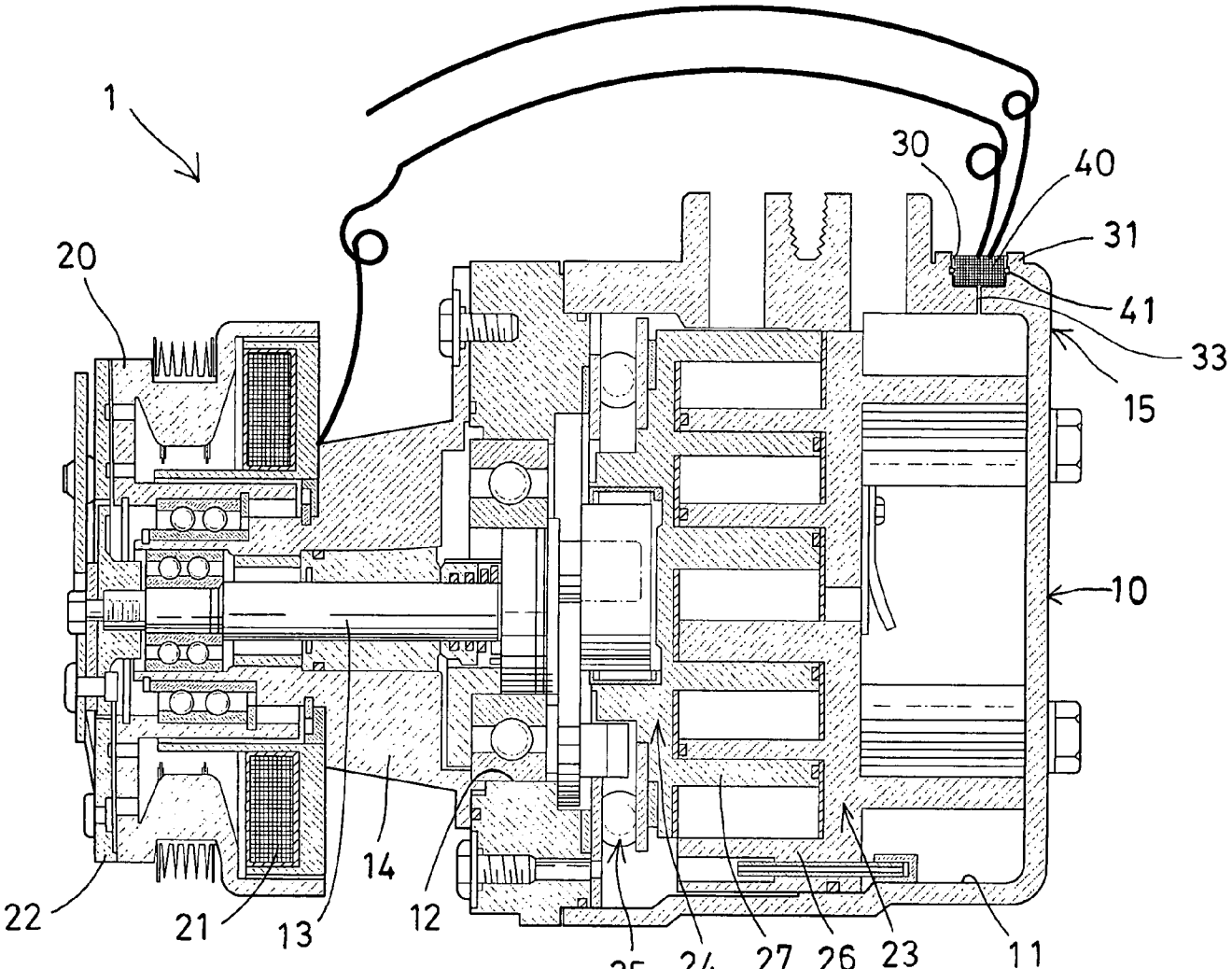
FIG. 1 is a cross sectional view of a fluid displacement apparatus in accordance with the present invention.

Referring to the drawings, and initially to FIG. 1 a fluid displacement apparatus 1 in accordance with the present invention comprises a compressor housing 10 including a chamber 11 formed therein, and including an opening 12 formed therein and communicating with the chamber 11 of the housing 10 for rotatably receiving a driving shaft 13, a sleeve 14 may be attached or secured to the housing 10 for rotatably supporting the driving shaft 13. A pulley 20, an electromagnetic coil 21, and an armature plate 22 are attached or engaged onto the driving shaft 13 for forming a magnetic clutch and for allowing the driving shaft 13 to be rotated or transmitted by the magnetic clutch, in which the driving shaft 13 is coupled to and driven by an external power source, for example the engine of an automobile, through the rotation transmitting magnetic clutch.

A fixed scroll 23 is disposed and secured in the chamber 11 of the housing 10, and an orbiting scroll 24 is rotatably received and engaged in the chamber 11 of the housing 10 with such as a thrust bearing device 25, and coupled to and driven by such as the driving shaft 13 and/or the rotation transmitting magnetic clutch, and the fixed scroll 23 and the orbiting scroll 24 each include a wrap or spiral element interfited or acted with each other for compressing the fluid or refrigerant received in the compressor housing 10 and for generating the compressed or pressurized refrigerant, and for supplying the compressed or pressurized refrigerant to the air cooling systems or the like. The above-described structure is typical and will not be described in further details.

As shown in FIGS. 1-4, the compressor housing 10 further includes a compartment 30 formed in the outer peripheral portion 15 of the housing 10, and formed or defined by an outer casing 31 for receiving a pressure sensing device 40, and having an opening 32 for communicating with the outer environment of the compressor housing 10 for allowing the pressure sensing device 40 to be engaged into the compartment 30 of the outer casing 31 or of the housing 10, and includes a slit or passage 33 also formed in the outer peripheral portion 15 of the housing 10 and communicating with the compartment 30 of the outer casing 31 or of the housing 10 for allowing the compressed or pressurized refrigerant to flow from the chamber 11 of the housing 10 and to flow through the passage 33 and then to flow into the compartment 30 of the outer casing 31 or of the housing 10.

Figure 2:
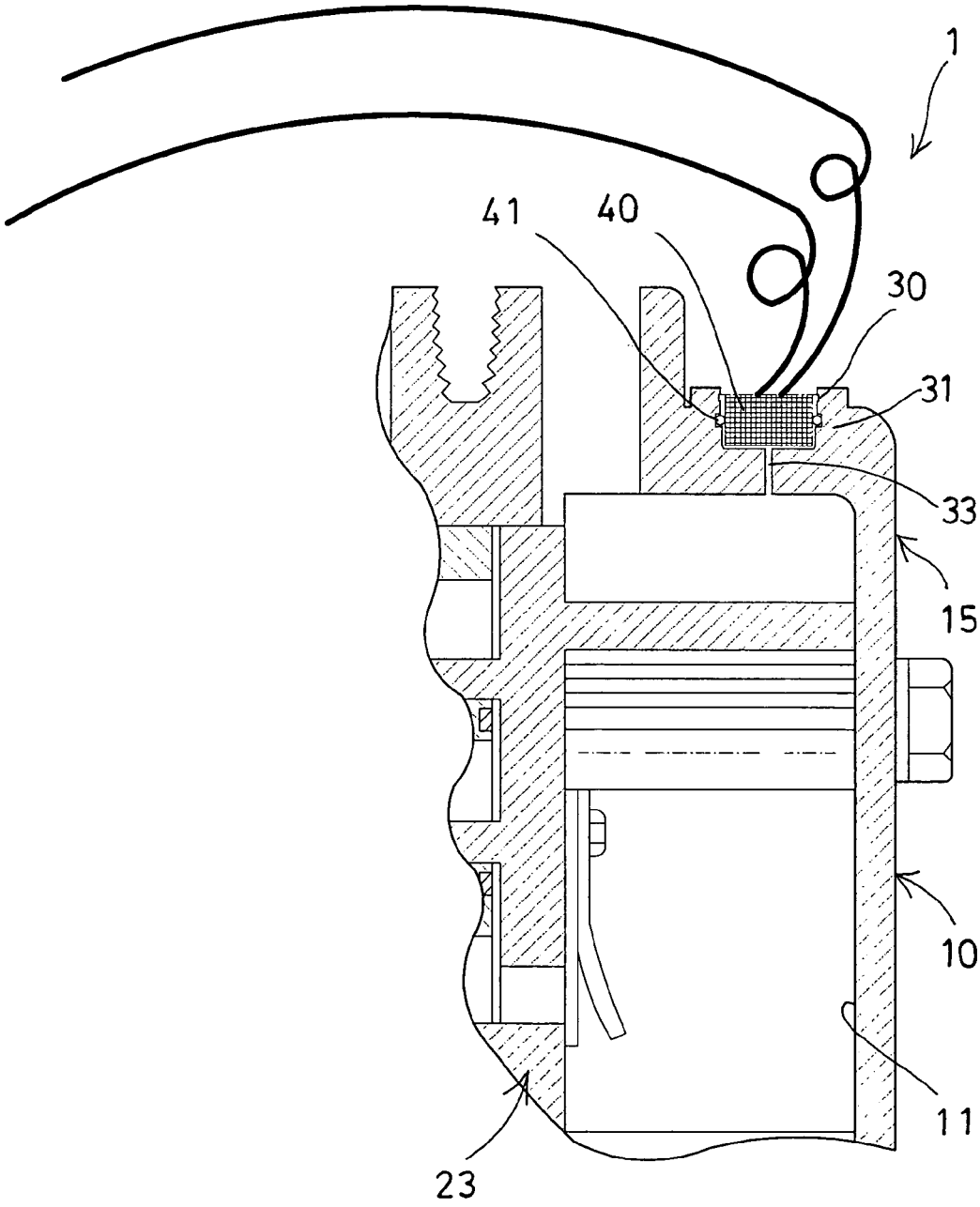
FIG. 2 is an enlarged partial cross sectional view of the fluid displacement apparatus.
Figure 3:
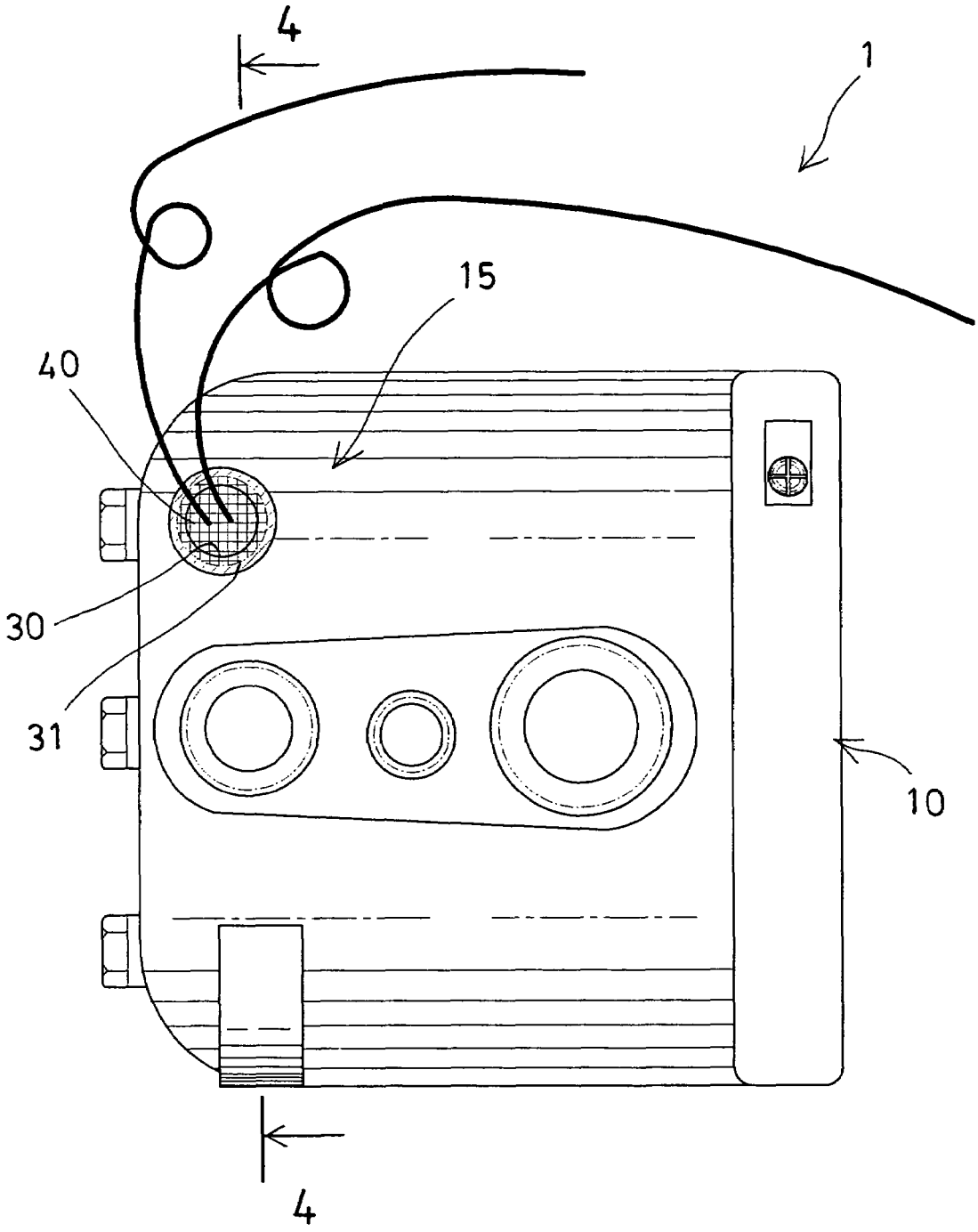
FIG. 3 is a partial top plan schematic view of the fluid displacement apparatus.
Figure 4:
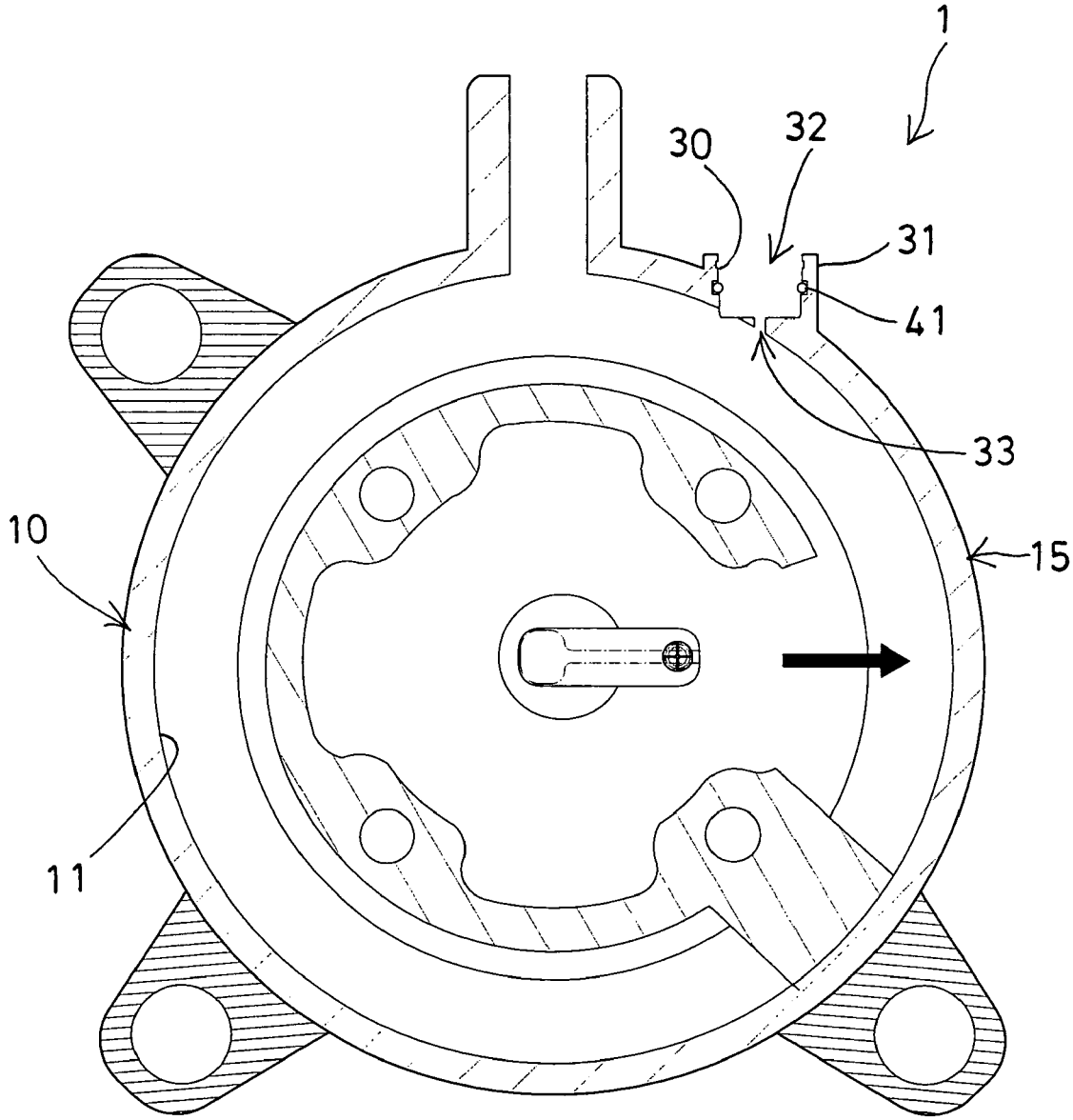
FIG. 4 is a partial cross sectional view of the fluid displacement apparatus illustrating the inner structure of the fluid displacement apparatus.

In operation, as shown in FIGS. 1 and 2, the pressure sensing device 40 engaged in the compartment 30 of the outer casing 31 or of the housing 10 may effectively detect or sense the pressure of the compressed or pressurized refrigerant for detecting whether the fluid or refrigerant in the compressor housing 10 is over pressure or not, and/or for preventing the fluid displacement apparatus 1 from being operated with the over-pressurized fluid or refrigerant. A sealing ring 41 may further be provided and engaged with the pressure sensing device 40 and the outer casing 31 or the housing 10, or engaged between the pressure sensing device 40 and the outer casing 31 or the housing 10 for making an air or water tight seal between the pressure sensing device 40 and the outer casing 31 or the housing 10 and for preventing the fluid or refrigerant from leaking.

A fastener or other locking or retaining device (not shown) may further be provided and engaged with the pressure sensing device 40 for stably anchoring or securing the pressure sensing device 40 to the outer casing 31 or the housing 10 and for preventing the pressure sensing device 40 from being disengaged from the outer casing 31 or the housing 10. However, it is to be noted that the attaching or anchoring or securing of the pressure sensing device 40 to the outer casing 31 or the housing 10 is not related to the present invention and will not be described in further details.

It is further to be noted that, in a compressor, such as a scroll compressor, a swash plate type compressor, or the like, the pressure of the fluid or refrigerant is related or proportional to the temperature of the fluid or refrigerant; i.e., when the temperature of the fluid or refrigerant is increased or higher, the pressure of the fluid or refrigerant will be increased. Accordingly, when the pressure of the fluid or refrigerant is detected or sensed to be higher or greater than a predetermined value, the information of the detected or sensed higher or greater pressure of the fluid or refrigerant may be sent to such as a control device or processor device (not shown) for controlling or switching off such as the electromagnetic coil 21 of the fluid displacement apparatus 1, or may be directly coupled to the electromagnetic coil 21 in order to control or to switch off the electromagnetic coil 21 of the fluid displacement apparatus 1 when the fluid or refrigerant is over-pressurized.

Accordingly, the fluid displacement apparatus in accordance with the present invention includes a pressure sensing device for effectively detecting or sensing the inner pressure in a compressor housing and for detecting whether the fluid or refrigerant in the compressor housing is over pressure or not, and for switching off the fluid displacement apparatus when the fluid or refrigerant is over-pressurized, and for protecting the fluid displacement apparatus from being damaged by the over-pressurized fluid or refrigerant.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A fluid displacement apparatus comprising:

a housing including a chamber formed therein for receiving a refrigerant, and including an opening formed therein and communicating with said chamber of said housing, and including a casing having a compartment formed in said casing, and including a passage formed in said housing and communicating with said compartment and said chamber of said housing, said casing including an opening formed therein, a driving shaft rotatably received in said opening of said housing, a fixed scroll disposed in said chamber of said housing, an orbiting scroll rotatably received and engaged in said chamber of said housing and interfitting with said fixed scroll for compressing the refrigerant and for generating a pressurized refrigerant, a pressure sensing device engaged through said opening of said casing and disposed in said compartment of said housing for sensing a pressure of the pressurized refrigerant, and a sealing ring engaged between said pressure sensing device and said casing.

* * * * *